US007658224B2

(12) United States Patent
Beech

(10) Patent No.: US 7,658,224 B2
(45) Date of Patent: Feb. 9, 2010

(54) FLANGED CONNECTION FOR HEAT EXCHANGER

(75) Inventor: Stephen Beech, Ontario (CA)

(73) Assignee: Dana Canada Corporation, Oakville, Ontario (CA)

( * ) Notice: Subject to any disclaimer, the term of this patent is extended or adjusted under 35 U.S.C. 154(b) by 775 days.

(21) Appl. No.: 11/230,094

(22) Filed: Sep. 19, 2005

(65) Prior Publication Data

US 2007/0062681 A1 Mar. 22, 2007

(51) Int. Cl.
*F28F 3/14* (2006.01)
*F28F 9/04* (2006.01)
*F28D 1/02* (2006.01)

(52) U.S. Cl. ..... 165/170; 165/178

(58) Field of Classification Search ..... 165/153, 165/166, 170, 178; 285/41, 139
See application file for complete search history.

(56) References Cited

U.S. PATENT DOCUMENTS

| | | | | |
|---|---|---|---|---|
| 2,983,993 | A | 5/1961 | Johnson | |
| 3,911,843 | A | 10/1975 | Stowell | |
| 4,258,785 | A | 3/1981 | Beldam | |
| 4,700,445 | A | 10/1987 | Raskin | |
| 5,280,971 | A | 1/1994 | Tokutake et al. | |
| 5,358,034 | A | 10/1994 | Nishishita et al. | |
| 5,433,268 | A | 7/1995 | Janezich et al. | |
| 5,513,700 | A | 5/1996 | Kleve et al. | |
| 5,551,506 | A | 9/1996 | Nishishita | |
| 5,553,664 | A | 9/1996 | Nishishita et al. | |
| 5,711,370 | A | 1/1998 | Tanaka | |
| 5,785,119 | A | 7/1998 | Watanabe et al. | |
| 5,975,193 | A | 11/1999 | Tokita et al. | |
| 6,050,330 | A * | 4/2000 | Schmit et al. | 165/170 |
| 6,070,659 | A | 6/2000 | Hosoya | |
| 6,536,516 | B2 | 3/2003 | Davies et al. | |
| 6,814,136 | B2 * | 11/2004 | Yi et al. | 165/153 |
| 2003/0178182 | A1 * | 9/2003 | Pikovsky et al. | 165/80.4 |

* cited by examiner

*Primary Examiner*—Tho V Duong
(74) *Attorney, Agent, or Firm*—Ridout & Maybee LLP

(57) ABSTRACT

A heat exchanger including a plate pair having first and second plates each having an outward depression extending to a peripheral edge thereof, the first and second plates defining a fluid channel therebetween and secured to one another with the outward depressions defining a flow opening in communication with the fluid channel. An outer flange extends substantially around a periphery of the flow opening. A tubular fitting with a first end and an outer surface having an annular flange thereon spaced apart from the first end is secured to the plate pair with the first end received within the flow opening and the annular flange abutting against the outer flange.

17 Claims, 6 Drawing Sheets

FLANGED CONNECTION FOR HEAT EXCHANGER

FIELD OF THE INVENTION

The present invention relates to a connection for an inlet or outlet of a heat exchanger, and more particularly to a flanged connection for an inlet or outlet of a heat exchanger.

BACKGROUND OF THE INVENTION

Low profile heat exchangers typically use inlet and outlet fittings that are attached to openings in the top plate of the heat exchanger. The inlet and outlet fittings are often elbow-type fittings. A disadvantage with this type of fitting is that it creates a pressure drop thereby reducing heat exchanger performance. Another disadvantage is that the fittings are often machined from aluminum. This type of fitting is costly to manufacture and must be secured to the heat exchanger, for example using brazing, which introduces an additional manufacturing step thereby increasing the cost and complexity of manufacturing the heat exchanger.

Stacked plate type heat exchangers are comprised of a number of plates forming integral header tanks. This type of heat exchanger typically uses inlet and outlet fittings that are attached to one end of each tank. In conventional designs, the location of inlet and outlet fittings may impose restrictions on the use and design of this type of heat exchanger. Further, the installation of inlet and outlet fittings may require additional manufacturing steps that may be costly and time consuming.

Accordingly, there is a need for an inlet or outlet connection for a heat exchanger which is robust, efficient and economic to manufacture.

SUMMARY

The present invention provides a flanged connection for an inlet or outlet of a heat exchanger, for example a low profile heat exchanger or stacked plate type heat exchanger. According to one example of the present invention, there is provided a heat exchanger having a plate pair including first and second plates each having an outward depression extending to a peripheral edge thereof, the first and second plates defining a fluid channel therebetween and secured to one another with the outward depressions defining a flow opening in communication with the fluid channel. The first plate includes an integral semi-annular first plate flange portion formed about a periphery of the first plate outward depression at a peripheral edge of the first plate and the second plate includes an integral semi-annular second plate flange portion formed about a periphery of the second plate outward depression at a peripheral edge of the second plate, the semi-annular first and second plate flange portions collectively providing an outer flange extending substantially around a periphery of the flow opening. The heat exchanger includes a tubular fitting with a first end and an outer surface having an annular flange thereon spaced apart from the first end, the tubular fitting being secured to the plate pair with the first end received within the flow opening and the annular flange abutting against the outer flange.

According to another example embodiment, there is provided a heat exchanger with a pair of substantially planar first and second plates each having a peripheral edge portion surrounding a central portion, the plates being sealably joined about the peripheral edge portions thereof and defining a fluid channel between the central portions thereof, the first and second plates each including an outward depression extending to an edge thereof, the outward depressions cooperating to form a flow opening communicating with the fluid channel and extending through the peripheral edge portions of the first and second plates. The first plate includes a semi-annular first plate flange portion formed about a periphery of the plate outward depression at the peripheral edge portion of the first plate and the second plate including a semi-annular second plate flange portion formed about a periphery of the second plate outward depression at the peripheral edge portion of the second plate, the first plate flange portion and second plate flange portion jointly forming an outer flange extending substantially around a periphery of the flow opening, the outer flange having a substantially planar surface facing away from the flow opening. The heat exchanger also includes a tubular fitting having a body portion with a first end and an annular flange on an outer surface of the body portion spaced apart from the first end, the tubular fitting being secured to the plate pair with the first end received within the flow opening and the annular flange abutting against the substantially planar surface of the outer flange.

According to a further example, there is provided a method for forming a heat exchanger, including: providing a pair of substantially planar plates; forming in each of the plates an outward depression extending to a peripheral edge thereof from a location spaced inward from the peripheral edge thereof; forming a semi-annular flange portion on each of the plates about a periphery of the outward depression at the peripheral edge of the plate; arranging the plates together to define a fluid channel therebetween with the outward depressions defining a flow opening in communication with the fluid channel and with the semi-annular flange portions collectively forming an outer flange substantially about a periphery of the flow opening; providing a tubular fitting with a first end and an outer surface having an annular flange thereon spaced apart from the first end, and inserting the first end within the flow opening until the annular flange abuts against the outer flange; and securing the plates and the tubular fitting together.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings which show, by way of example, embodiments of the present invention, and in which.

Similar references are used in different figures to denote similar components.

DETAILED DESCRIPTION OF THE DRAWINGS

Figure 1:
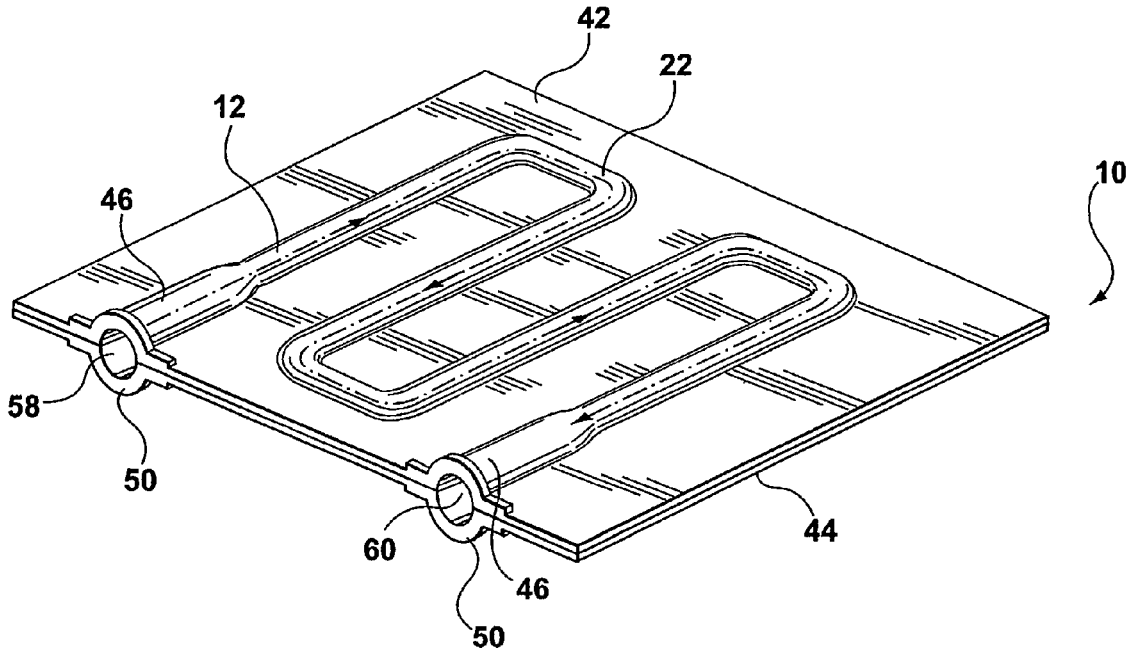
FIG. 1 is a perspective view of one embodiment of a low profile heat exchanger according to the present invention.

Reference is first made to FIG. 1, which shows an example of a low profile heat exchanger 10 to which example embodiments may be applied. The heat exchanger 10 includes a substantially planar first or upper plate 42 and substantially planar second or lower plate 44 defining an internal fluid flow channel therebetween. In the shown embodiment, the fluid flow channel (illustrated by dashed line 12 in FIG. 1) is defined by cooperating serpentine grooves 22 formed in the upper and lower plates 42 and 44. The fluid flow channel 12 extends between fluid flow openings 58, 60 that are located at a peripheral edge of the heat exchanger 10 and which function as a fluid inlet and a fluid outlet to the fluid flow channel 12 for a heat exchanger fluid. Although shown as serpentine in the Figures, the fluid flow channel 12 defined by the plates 42, 44 may take other configurations—for example, among other things, the fluid flow channel could be a rectangular chamber having internal flow circuiting baffles or turbulizing structures. Although not shown, in some embodiments an air side fin plate having a plurality of spaced apart fins may be attached to an external surface of the first and/or second plates 42, 44.

Figure 2:
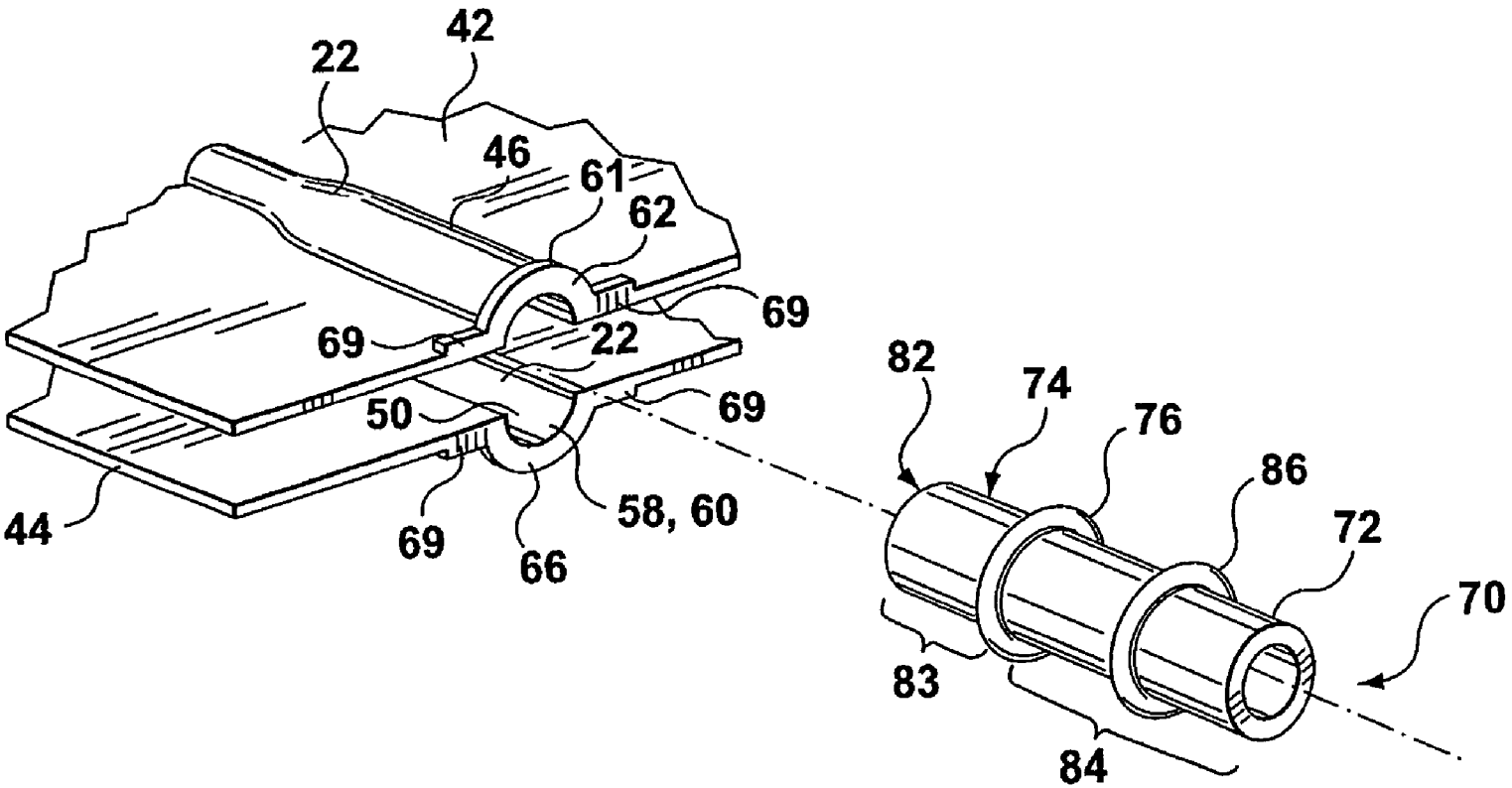
FIG. 2 is a perspective exploded view of one embodiment of a flanged connection according to the present invention.
Figure 3:
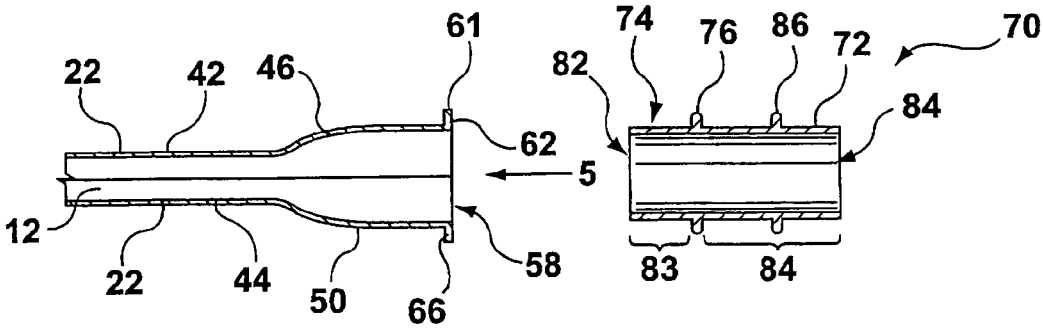
FIG. 3 is a sectional exploded view showing the flanged connection of FIG. 2 and a tubular fitting for insertion therein.
Figure 4:
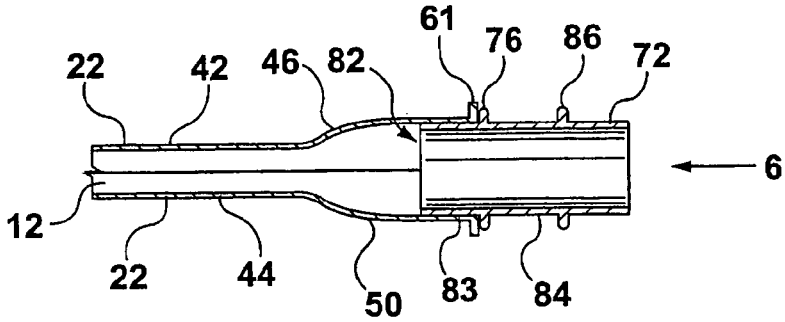
FIG. 4 is a sectional view showing the flanged connection of FIG. 3 having the tubular fitting inserted therein.

As shown in FIG. 2 to 4, a tubular fitting 70 is secured to each of the flow openings 58, 60 to enable inlet and outlet tubing to be connected to the heat exchanger 10. The connection of the tubular fitting 70 to flow openings 58, 60 will now be described in greater detail. As seen in FIGS. 1 to 4, the lower plate 44 is formed with spaced apart bosses or outward depressions 50 located at an edge thereof. The outward depressions 50 extend from opposite ends of groove 22 to the edge of the lower plate 44. The upper plate 42 is formed with corresponding spaced apart outward depressions 46 located at an edge thereof. The outward depressions 46 extend from opposite ends of groove 22 to the edge of the upper plate 42. The upper and lower plates 42, 44 are secured to each other, typically along the peripheral edges thereof. In embodiments such as that shown as FIG. 1, central portions of the plates 42, 44 that border the grooves 22 are also secured together. The outward depressions 46 of the upper plate 42 are aligned with the outward depressions 50 of the lower plate 44 such that when the plates are secured, the outward depressions 46 and 50 define the spaced apart fluid openings 58, 60, which communicate with opposite ends of the flow channel 22. In example embodiments, the contoured plates 42, 44 are formed though stamping or roll-forming of braze-clad metal, however the plates could alternatively be formed using other methods and/or out of other materials, such as plastic or composite materials.

In an example embodiment, flow openings 58, 60 have a substantially circular cross-section at the edge of the heat exchanger 10, and as indicated in FIGS. 2-4, a circular outer flange 61 extends substantially about the periphery of each flow opening 58, 60, providing a substantially planar bonding surface around the periphery of each flow opening 58, 60. In the embodiment of FIGS. 2-4, each circular flange 61 is formed by half flange portions 62 and 66 (e.g. semi-annular or semi-circular flange portions) that are integrally formed with the first and second plates 42, 44 at the edges thereof about the periphery of outward depressions 46, 50. When the upper and lower plates 42 and 44 are secured to each other, the half flange portions 62, 66 form annular flanges 61 extending around an edge of the openings 58, 60. Although the flow openings 58 and 60 and annular flanges 61 are shown as circular in the figures, such openings and the surrounding annular flanges may be non-circular in alternative configurations. For example, the flow openings 58, 60 could be elliptical or oval, or have multiple sides such as hexagonal or pentagonal, for example, and the surrounding flanges 61 have a corresponding configuration. Thus, the annular flange 61 is not restricted to a "circular" configuration but can take other configurations as required to surround the corresponding opening 58, 60. In the shown embodiment, the half flange portions 62, 66 include trailing edges 69; however in other embodiments the trailing edges 69 may not be present. The semi-annular flange portions 62 and 66 are, in some example embodiments, formed from portions of the plates 42 and 44 that have been bent outwards so that the flange portions 62 and 66 are substantially perpendicular to the remainder of the plates 42, 44, respectively.

Tubular fittings 70 are partially received in and secured within the openings 58, 60. Each tubular fitting 70 includes a body 72 having an outer surface 74. A first annular ring or flange 76 extends around the outer surface 74. The first annular flange 76 is inset from a first end 82 of the tubular fitting 70 and extends radially outward therefrom. The body 72 includes an inner portion 83, adjacent the first end 82 and an outer portion 84. The inner portion 83 is disposed within the opening 58, 60, with the first annular flange 76 abutting against the outer flange 61. The tubular fitting 70 may be brazed or otherwise secured such that a sealed connection between the first annular flange 76 and flange 61 is formed about the circumference of opening 58, 60.

Figure 5:
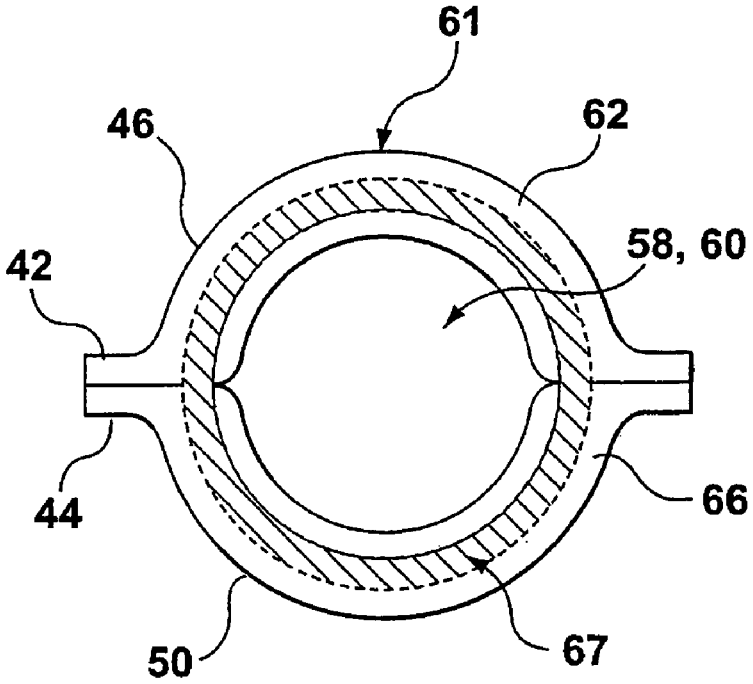
FIG. 5 is an end view of the flanged connection of FIG. 3 taken in the direction indicated by the arrow 5.
Figure 6:
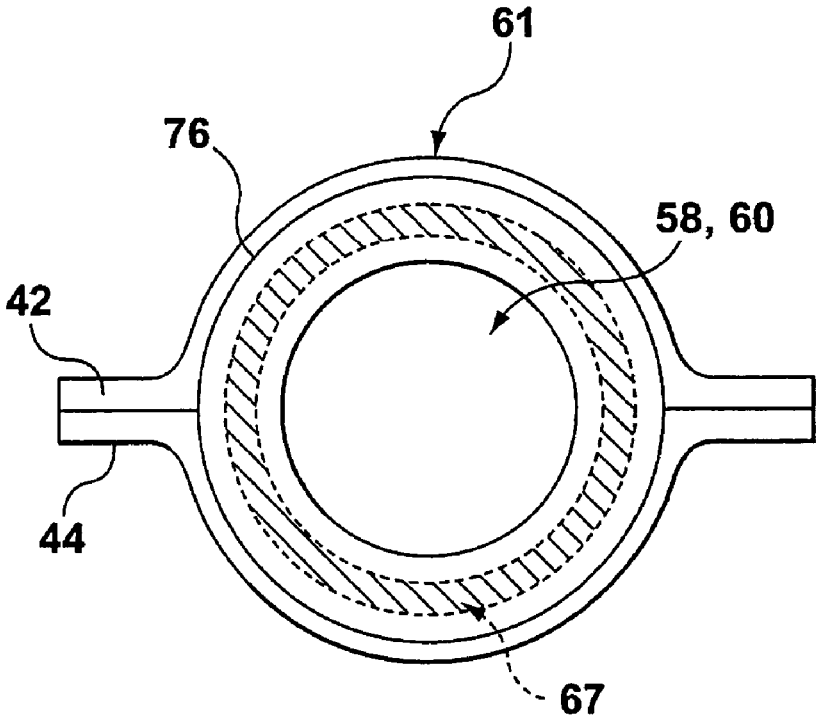
FIG. 6 is an end view of the flanged connection of FIG. 4 taken in the direction indicated by the arrow 6 showing the tubular fitting secured to the flanged connection.

As shown in FIG. 5 and 6, the flange 61 provides a flat annulus 67 for securely mounting the tubular fittings 70. When a tubular fitting 70 is received in the openings 58, 60, its outer flange 76 abuts the flange 61 in the area defined by the flat annulus 67 and may, in some applications, allow a reduction in or elimination of the problems associated with braze voids. In an example embodiment, the outer flange 61 has a larger outer diameter than fitting flange 76 such that flange 61 extends further radially outward than flange 76. In other example embodiments, flange 61 is less than or the same size as flange 76.

Referring again to FIG. 3, a further annular flange 86 spaced apart from first flange 76 is provided around the outer surface 74 of the body 72 in the outer portion 84 of the tubular fitting 70. The further flange 86 acts as a barb or nipple to allow hoses, tubing, or other flexible conduit, such as fuel or coolant lines, to be attached to the tubular fitting 70 for the delivery/removal of fluid to/from the heat exchanger 10. A hose (not shown) may be slipped over the flange 86 and secured thereto using a hose clamp (not shown) or other suitable fastener.

In the shown embodiment, openings 58, 60 are generally circular and the body 72 of the tubular fitting 70 is generally cylindrical. In some embodiment, the body 72 has an outer diameter substantially the same as the diameter of the openings 58, 60. The openings 58, 60 may in some embodiments be non-circular, such as elliptical or oval or multi-sided for example, with the body 72 having a corresponding mating shape.

The outer portion 84 of the tubular fittings 70 may be implemented in a variety of ways depending on the type of connections that are contemplated for a particular application. For example, in some embodiments rather than having a flange 86 for connecting to a hose, the tubular fitting 70 may include an internally threaded surface adapted to receive an externally threaded connector, plug or conduit. Thus, a threaded connector or plug with a temperature sensor or other measuring device therein could be threaded into the fitting 70 for measurement of a desired characteristic of the fluid flowing within the heat exchanger. In other embodiments, the tubular fitting 70 may have an externally threaded portion to receive an internally threaded connector, plug or conduit. In other embodiments, the outer portion 84 the tubular fitting 70 has a reduced diameter internal cylindrical surface for receiving an insert with a friction fit. Alternatively, outer portion 84 may have a grove for a crimp connection. A quick connect configuration could also be provided on outer portion 84.

In some embodiments, the upper and lower plates 42, 44 are secured to each other using brazing, and the tubular fitting 70 is secured with its flange 76 against the flange 61 using brazing. However, in other embodiments welding, thermal adhesive or other suitable means may be used.

The flanged connection described above may be used to provide any number of the inlets and/or outlets of a heat exchanger. Further, although the inlet and outlet connections in the shown embodiments are located on a common side of the heat exchanger 10, it will be appreciated that a different arrangement or configuration of the inlet and outlet connections are possible, and that the connections may be located on any edge of the heat exchanger 10. For example, in some embodiments the connections may be located on opposite sides of the heat exchanger or on adjacent corners. In some embodiments, only one of the inlet or outlet fitting may use the presently described connection.

Figure 7:
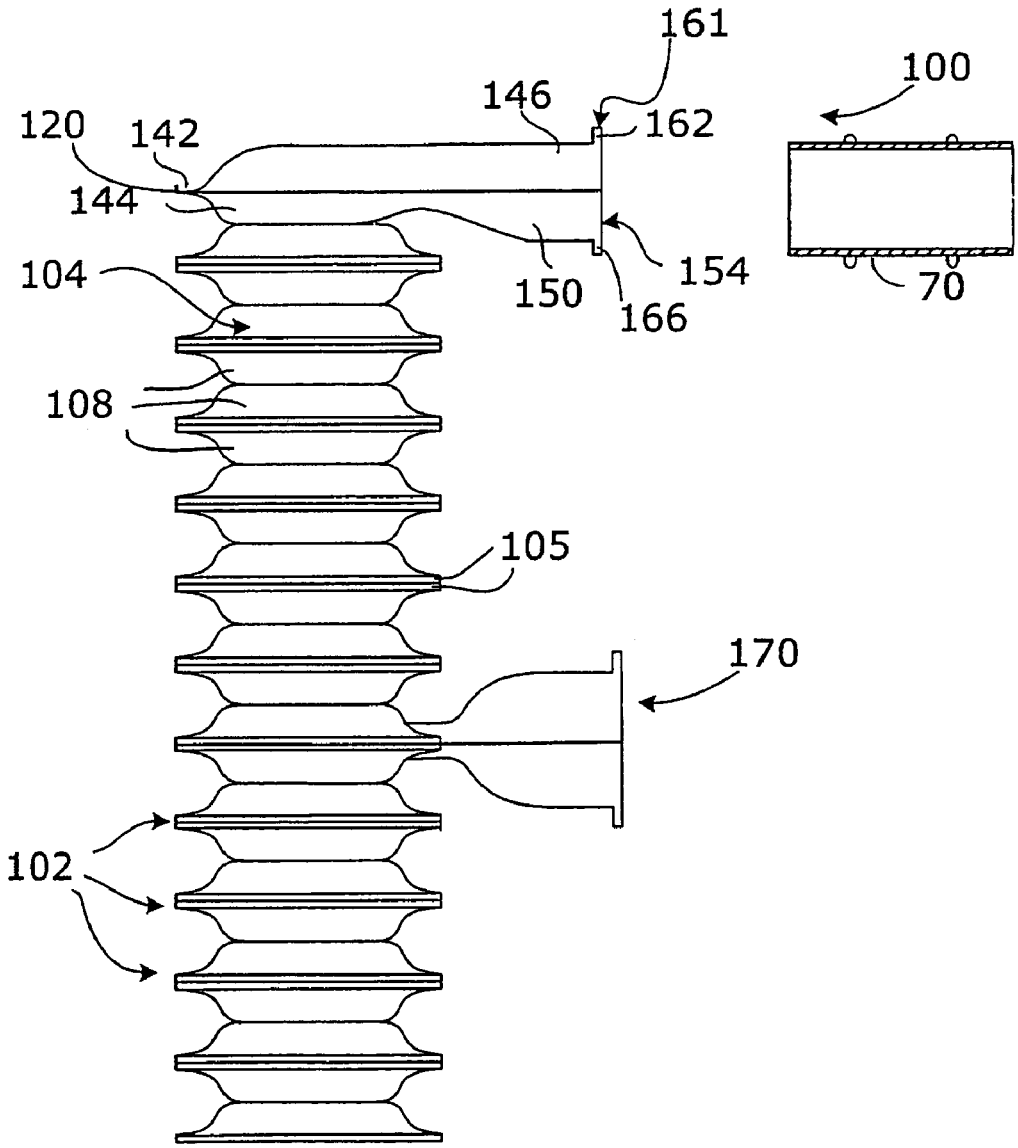
FIG. 7 is an end view of one embodiment of a stacked plate heat exchanger according to the present invention.
Figure 8:
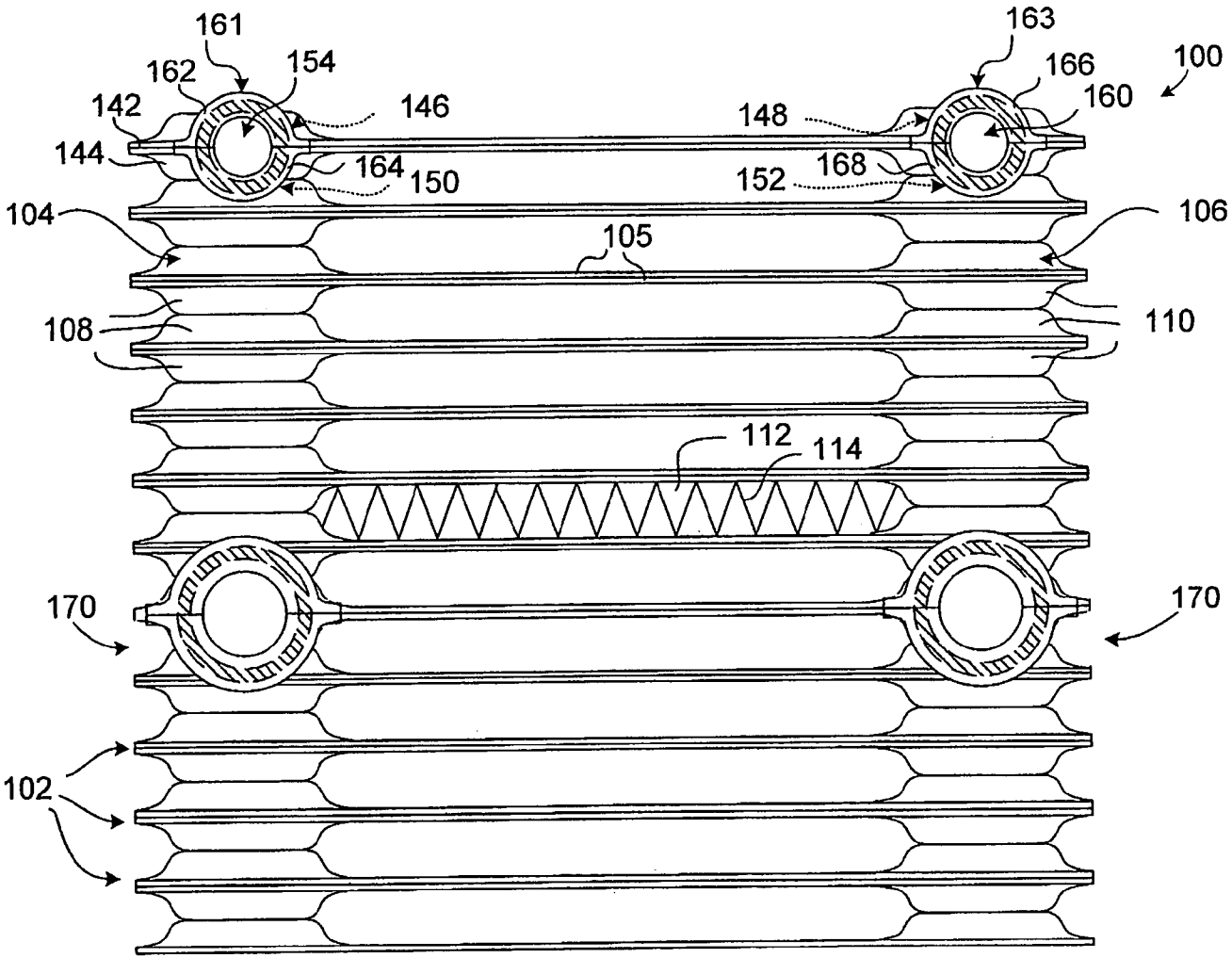
FIG. 8 is front view of the heat exchanger of FIG. 7.

Although the flanged connection has been described above in combination with a low profile heat exchanger formed from a single pair of plates, the flanged connection could also be applied to a stacked-plate type of heat exchanger. For example, with references to FIGS. 7 and 8, an example embodiment of a multiple stacked plate heat exchanger 100 will be described. The heat exchanger 100 comprises a plurality of stacked heat exchanger plate pairs 102 each defining an internal flow channel and having raised or enlarged portions at the opposite ends thereof to form inlet and outlet header tanks 104, 106 respectively. Each plate pair 102 is formed of a pair of facing dished plate members 105 fixed along their peripheral edges and provided with enlarged portions 108, 110 at the opposite ends of the heat exchanger having openings (not shown) therein. The enlarged portions 108, 110 combine to form the inlet and outlet header tanks 104, 106 respectively. The openings in the enlarged portions 108, 110 are axially aligned to provide a vertical flow passage through the header tanks. The plate pairs 102 may be spaced apart to form air side inter-plate passages 112 and fins 114 may be located in such passages.

Included among the plate pairs 102 is a plate pair 120 (shown as the top plate pair in the illustrated example) that includes upper and lower plates 142 and 144 respectively. The upper plate 142 is formed with spaced apart enlarged, outward depressions 146, 148 located at an edge thereof. The lower plate 144 is formed with corresponding spaced apart enlarged, outward depressions 150, 152 located at an edge thereof. The outward depressions 146, 148 of the upper plate 142 are aligned with the outward depressions 50, 152 of the lower plate 144 such that when the plates 142, 144 are secured, the upper plate depressions 146 and 148 define with lower plate depressions 150 and 152, respectively, spaced apart fluid flow openings 154, 160 that communicate with an internal flow channel through plate 120 and, respectively, with the header tanks 104, 106.

Half flange portions 162 and 164 (e.g. semi-circular flange members) integrally formed with the upper plate 142 are provided around the edges of outward depressions 146, 148 of the upper plate 142. Half flange portions 166 and 168 (e.g. semi-circular flange members) integrally formed with the lower plate 144 are provided around the edges of outward depressions 150, 152 of the lower plate 144. When the upper and lower plates 142 and 144 are secured to each other, the half flange portions 162, 164, 166, 168 form annular flanges 161, 163 extending around an edge of the openings 154, 160. Thus, the flow openings of plate pair 120 have a similar configuration to the flow openings of the plate pair of FIGS. 1-4. Tubular fittings 70 are secured within the openings 154, 160 with fitting annular flange 76 in abutting relation against the flanges 161, 163 in the manner described above in respect of the plate pairs of FIGS. 1-4. In addition to being used on the top or bottom plate pair in a stacked plate pair, the flanged connection could also be applied to plate pairs within the stack, as illustrated by connections 170 in FIGS. 7 and 8.

Heat exchangers require fluid inlets and outlets for allowing fluid to enter and exit the internal fluid flow passage(s). Embodiments of the present invention provide a connection and connector for heat exchanger inlets and outlets that may be used in many types of heat exchanger designs, including low profile or single plate type heat exchangers and multiple plate or stacked plate type heat exchangers.

In some example embodiments, the integration of the inlet and outlet fittings into the edge area of the plates of the heat exchanger, simplifies the manufacturing process and lowers cost. Further, the flange connections of the present invention, depending on the particular embodiment and application, may reduce fluid pressure drop and increase heat exchanger performance as a result of the eliminating of 90° bends or elbows at the inlet and outlets. The provision of a flat annulus around the inlet/outlet openings provide a securing surface for the inlet/outlet fittings.

The presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A heat exchanger comprising:

a plate pair including first and second plates each having an outward depression extending to a peripheral edge thereof, the first and second plates defining a fluid channel therebetween and secured to one another with the outward depressions defining a flow opening in communication with the fluid channel, the first plate including an integral semi-annular first plate flange portion formed about a periphery of the first plate outward depression at a peripheral edge of the first plate and the second plate including an integral semi-annular second plate flange portion formed about a periphery of the second plate outward depression at a peripheral edge of the second plate, the semi-annular first and second plate flange portions collectively providing an outer flange extending substantially around a periphery of the flow opening; and a tubular fitting with a first end and an outer surface having an annular flange thereon spaced apart from the first end, the tubular fitting being secured to the plate pair with the first end received within the flow opening and the annular flange abutting against the outer flange.

2. The heat exchanger of claim 1 wherein the first and second plates and the tubular fitting are formed from metal and brazed together.

3. The heat exchanger of claim 1 wherein the first and second plates each have a further outward depression extending to a peripheral edge thereof, the further outward depressions defining a further flow opening in communication with the fluid channel, the first plate including a further integral semi-annular first plate flange portion formed about a periphery of the first plate further outward depression at a peripheral edge of the first plate and the second plate including a further integral semi-annular second plate flange portion formed about a periphery of the second plate further outward depression at a peripheral edge of the second plate, the further semi-annular first and second plate flange portions providing a further outer flange extending substantially around a periphery of the further flow opening; and a further tubular fitting with a first end and an outer surface having an annular flange thereon spaced apart from the first end, the further tubular fitting being secured to the plate pair with the first end thereof received within the further flow opening and the annular flange thereof abutting against the further outer flange.

4. The heat exchanger of claim 3 wherein the fluid channel is provided through a serpentine groove formed in at least one of the first and second plates.

5. The heat exchanger of claim 1 including a plurality of further plate pairs each defining a fluid channel therebetween, the plate pair and further plate pairs being aligned in a plate pair stack, the plates of the plate pairs having cooperating openings formed therein for circuiting fluid through the fluid channels.

6. The heat exchanger of claim 1 wherein the first plate flange portion extends substantially perpendicular from a remainder of the first plate and the second plate flange portion extends substantially perpendicular from a remainder of the second plate.

7. The heat exchanger of claim 1 wherein the outer flange and the annular flange have cooperating planar annular surfaces.

8. A heat exchanger comprising:

a pair of substantially planar first and second plates each having a peripheral edge portion surrounding a central portion, the plates being sealably joined about the peripheral edge portions thereof and defining a fluid channel between the central portions thereof, the first and second plates each including an outward depression extending to an edge thereof, the outward depressions cooperating to form a flow opening communicating with the fluid channel and extending through the peripheral edge portions of the first and second plates, the first plate including a semi-annular first plate flange portion formed about a periphery of the first plate outward depression at the peripheral edge portion of the first plate and the second plate including a semi-annular second plate flange portion formed about a periphery of the second plate outward depression at the peripheral edge portion of the second plate, the first plate flange portion and second plate flange portion jointly forming an outer flange extending substantially around a periphery of the flow opening, the outer flange having a substantially planar surface facing away from the flow opening; and a tubular fitting having a body portion with a first end and an annular flange on an outer surface of the body portion spaced apart from the first end, the tubular fitting being secured to the plate pair with the first end received within the flow opening and the annular flange abutting against the substantially planar surface of the outer flange.

9. The heat exchanger of claim 8 wherein the outer flange extends a greater radial distance than the annular flange of the tubular fitting.

10. The heat exchanger of claim 8 wherein the first and second plates each have a further outward depression extending through the peripheral edge portions thereof, the further outward depressions defining a further flow opening in communication with the fluid channel the first plate including a further semi-annular first plate flange portion formed about a periphery of the first plate further outward depression at the peripheral edge portion of the first plate and the second plate including a further semi-annular second plate flange portion formed about a periphery of the second plate further outward depression at the peripheral edge portion of the second plate), the further semi-annular first and second plate flange portions providing a further outer flange extending substantially around a periphery of the further flow opening, the further outer flange having a substantially planar surface facing away from the further flow opening; and a further tubular fitting having a body portion with a first end and an annular flange on an outer surface of the body portion spaced apart from the first end, the further tubular fitting being secured to the plates pair with the first end thereof received within the further flow opening and the annular flange thereof abutting against the substantially planar surface of the further outer flange.

11. The heat exchanger of claim 10 wherein the fluid channel is provided through a serpentine groove formed in at least one of the first and second plates.

12. The heat exchanger of claim 8 including a plurality of further plate pairs each defining a fluid channel therebetween, the pair of first and second plates and further plate pairs being aligned in a plate pair stack, the plates of the plate pairs having cooperating openings formed therein for circuiting fluid through the fluid channels.

13. The heat exchanger of claim 8 wherein the first and second plates and the tubular fitting are formed from metal and brazed together.

14. The heat exchanger of claim 8 wherein the first plate flange portion extends substantially perpendicular from a remainder of the first plate and the second plate flange portion extends substantially perpendicular from a remainder of the second plate.

15. A method for forming a heat exchanger, comprising:

providing a pair of substantially planar plates;

forming in each of the plates an outward depression extending to a peripheral edge thereof from a location spaced inward from the peripheral edge thereof;

forming a semi-annular flange portion on each of the plates about a periphery of the outward depression at the peripheral edge of the plate;

arranging the plates together to define a fluid channel therebetween with the outward depressions defining a flow opening in communication with the fluid channel and with the semi-annular flange portions collectively forming an outer flange substantially about a periphery of the flow opening;

providing a tubular fitting with a first end and an outer surface having an annular flange thereon spaced apart from the first end, and inserting the first end within the flow opening until the annular flange abuts against the outer flange; and securing the plates and the tubular fitting together.

16. The method of claim 15 wherein the step of forming the semi-annular flange on each of the plates includes bending a portion of the planar plate outward to form the semi-annular flange with a substantially planar surface for contacting the annular flange.

17. The method of claim 15 wherein the step of securing includes brazing the plates and tubular fitting together.

* * * * *